US010018375B2

(12) United States Patent
Jiang et al.

(10) Patent No.: US 10,018,375 B2
(45) Date of Patent: Jul. 10, 2018

(54) ELECTRIC WATER HEATER

(71) Applicant: WUHU MIDEA KITCHEN AND BATH APPLIANCES MFG. CO., LTD., Wuhu (CN)

(72) Inventors: Yu Jiang, Wuhu (CN); Shaohe Qu, Wuhu (CN)

(73) Assignee: WUHU MIDEA KITCHEN AND BATH APPLIANCES MFG. CO., LTD., Wuhu (CN)

( * ) Notice: Subject to any disclaimer, the term of this patent is extended or adjusted under 35 U.S.C. 154(b) by 227 days.

(21) Appl. No.: 14/777,557

(22) PCT Filed: Apr. 29, 2015

(86) PCT No.: PCT/CN2015/077850
§ 371 (c)(1),
(2) Date: Sep. 16, 2015

(87) PCT Pub. No.: WO2016/041354
PCT Pub. Date: Mar. 24, 2016

(65) Prior Publication Data

US 2016/0290678 A1 Oct. 6, 2016

(30) Foreign Application Priority Data

Sep. 19, 2014 (CN) ..... 2014 2 0542457 U

(51) Int. Cl.
*F24H 9/16* (2006.01)

(52) U.S. Cl.
CPC ..... *F24H 9/16* (2013.01)

(58) Field of Classification Search
CPC ..... F24H 9/16
See application file for complete search history.

(56) References Cited

U.S. PATENT DOCUMENTS 969,776 A * 9/1910 Foley ..... E03B 9/10 137/371
2,768,766 A * 10/1956 Woebbeking ..... E03C 1/08 137/381

(Continued)

FOREIGN PATENT DOCUMENTS

CN 1194352 9/1998
CN 2796161 7/2006

(Continued)

OTHER PUBLICATIONS

International Searching Authority, International Search Report for PCT/CN2015/077850 dated Aug. 6, 2015.

*Primary Examiner* — Nathaniel Herzfeld
(74) *Attorney, Agent, or Firm* — Hodgson Russ LLP

(57) ABSTRACT

The present disclosure provides an electric water heater, including a casing, an inner tank, a drain valve and a protection cover. The casing defines an opening. An inner tank is disposed in the casing and defines a drain outlet. A drain valve is mounted at the drain outlet and exposed from the opening. A protection cover is detachably fixed on the casing or the drain valve and covers the drain valve. The protection cover of the electric water heater according to embodiments of the present disclosure may be detached from the casing during the sewage discharge and fixed on the casing again after the sewage discharge. Because of the protection of the protection cover, the drain valve is no more exposed so as to avoid the potential safety risk. In addition, the protection cover may further improve the integrity and the aesthetics of the appearance of the casing.

7 Claims, 4 Drawing Sheets

(56) References Cited

U.S. PATENT DOCUMENTS 3,181,555 A * 5/1965 Jacobson ..... F16K 27/0272 137/375
3,184,091 A * 5/1965 Hoffman ..... B65D 39/082 217/99
3,552,427 A * 1/1971 Jacobson ..... F16K 27/08 137/382
3,836,117 A * 9/1974 Panicali ..... F16K 31/58 251/351
4,193,575 A * 3/1980 Burgess ..... B65D 47/248 137/351
4,811,858 A * 3/1989 Augur ..... B65D 81/3886 215/13.1
5,028,383 A * 7/1991 Moore ..... F16K 17/02 251/61.2
7,484,720 B2 * 2/2009 Lange ..... F16F 9/0227 188/300
2002/0153498 A1 * 10/2002 Dougherty ..... G21F 5/002 250/506.1
2006/0283783 A1 * 12/2006 Adey ..... B03C 1/284 209/39
2012/0080062 A1 * 4/2012 Parker ..... B44D 3/006 134/198
2013/0241342 A1 9/2013 Soeda et al.
2013/0266296 A1 * 10/2013 Kreutzman ..... F24D 19/1048 392/308

FOREIGN PATENT DOCUMENTS

CN 203454415 2/2014
CN 103803675 5/2014
CN 204153985 2/2015
JP 2003000451 1/2003
JP 2011158122 8/2011

* cited by examiner

ELECTRIC WATER HEATER

CROSS-REFERENCE TO RELATED APPLICATION

The application is a national phase entry under 35 USC § 371 of International Application PCT/CN2015/077850, filed Apr. 29, 2015, which claims priority to and benefits of Chinese Patent Applications No. 201420542457.0, filed with the State Intellectual Property Office of P. R. China on Sep. 19, 2014, the entire contents of which are incorporated herein by reference

FIELD

The present disclosure relates to an electric water heating field, and more particularly to an electric water heater.

BACKGROUND

An inner tank of an electric water heater in the related art is formed with a drain outlet, and provided with a drain valve. A casing of the electric water heater is formed with an opening, and the drain valve is exposed from the opening for convenient operation. However, the drain valve is connected to the inner tank and thus electrified, so there will be a potential safety risk of the drain valve exposed outside of the casing.

SUMMARY

Embodiments of the present disclosure seek to solve at least one of the problems existing in the related art. Therefore, the present disclosure needs to provide an electric water heater.

The electric water heater according to an embodiment of the present disclosure includes a casing, an inner tank, a drain valve and a protection cover. The casing defines an opening. An inner tank is disposed in the casing and defines a drain outlet. A drain valve is mounted at the drain outlet and exposed from the opening. A protection cover is detachably fixed on the casing or the drain valve and covers the drain valve.

The protection cover of the electric water heater according to embodiments of the present disclosure may be detached from the casing during the sewage discharge, and fixed on the casing again after the sewage discharge. Because of the protection of the protection cover, the drain valve is no more exposed so as to avoid the potential safety risk. In addition, the protection cover may further improve the integrity and the aesthetics of the appearance of the casing.

In some embodiments, the protection cover comprises a tubular body and a first flange extended outwardly from an upper edge of the body and defining a through hole therein, the casing defines a screw hole at an edge of the opening, the protection cover is detachably fixed on the casing by a screw passing through the through hole and screwed into the threaded hole.

In some embodiments, the protection cover has a cup-shape, a first thread is formed at an inner side wall of the protection cover, the casing comprises a cup-shaped flange extended outwardly and surrounding the drain valve, the cup-shaped flange is positioned at the edge of the opening or within the casing and surrounded by the opening, a second thread is formed at an outer side wall of the cup-shaped flange, the protection cover is detachably fixed on the casing by the first and second threads engaged with each other.

In some embodiments, the protection cover has a cup-shape, at least two snapping tongues are formed at an outer side wall of the protection cover and distributed in a circumferential direction of the protection cover, and the protection cover is detachably fixed on the casing by engaging the snapping tongues with the edge of the opening.

In some embodiments, bumps are formed at the edge of the opening and the snapping tongues engage with the bumps respectively.

In some embodiments, the snapping tongue comprises two flanges extended from the outer side wall of the protection cover, and the bump is snap-fitted between the two flanges.

In some embodiments, the protection cover has a cup-shape, a third thread is formed at an outer side wall of the protection cover, the casing comprises a cup-shaped concave portion extended inwardly and surrounding the drain valve, a fourth thread is formed at an inner side wall of the concave portion, the protection cover is detachably fixed on the casing by the third and fourth threads engaged with each other.

In some embodiments, the protection cover is detachably connected to a valve body of the drain valve via a screw or a snapping tongue.

In some embodiments, a distance between the protection cover and the drain valve is greater than 2 mm.

In some embodiments, a part of the protection cover exposed outside of the casing has a truncated cone-shaped structure, and a diameter of the protection cover becomes smaller as a distance from the protection cover to the casing increases.

In some embodiments, a slant angle of the truncated cone-shaped structure of the protection cover ranges from 5° to 25°.

In some embodiments, the protection cover is made of PP, ABS or PVC.

In some embodiments, a rough structure is formed at an outer surface of the protection cover.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the drawings, in which.

DETAILED DESCRIPTION

Figure 1:
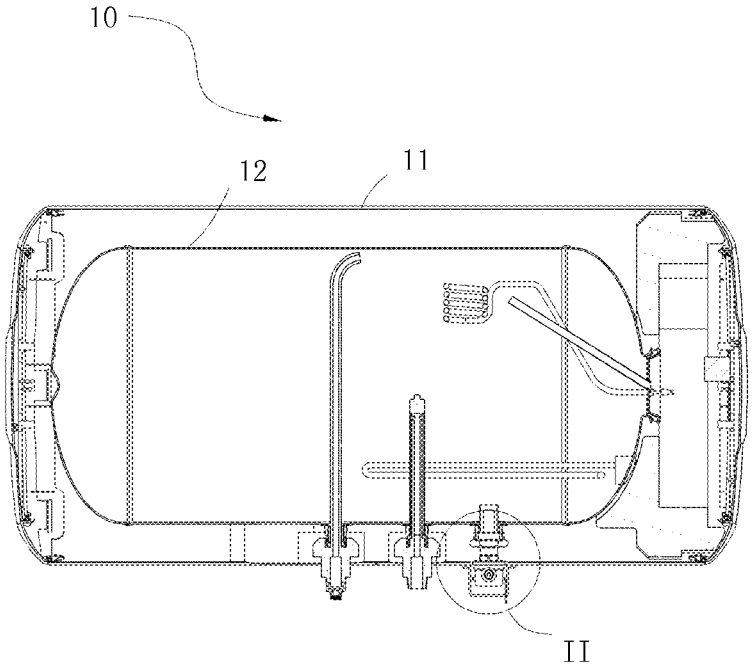
FIG. 1 is a schematic sectional view of an electric water heater according to a first embodiment of the present disclosure.

Embodiments of the present disclosure will be described in detail and examples of the embodiments will be illustrated in the drawings, where same or similar reference numerals are used to indicate same or similar members or members with same or similar functions. The embodiments described herein with reference to drawings are explanatory, which are used to illustrate the present disclosure, but shall not be construed to limit the present disclosure.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, "a plurality of" means at least two, e.g. two, three and so on, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which may be understood by those skilled in the art according to specific situations.

Various embodiments and examples are provided in the following description to implement different structures of the present disclosure. In order to simplify the present disclosure, certain elements and settings will be described. However, these elements and settings are only by way of example and are not intended to limit the present disclosure. In addition, reference numerals may be repeated in different examples in the present disclosure. This repeating is for the purpose of simplification and clarity and does not refer to relations between different embodiments and/or settings. Furthermore, examples of different processes and materials are provided in the present disclosure. However, it would be appreciated by those skilled in the art that other processes and/or materials may be also applied.

Figure 2:
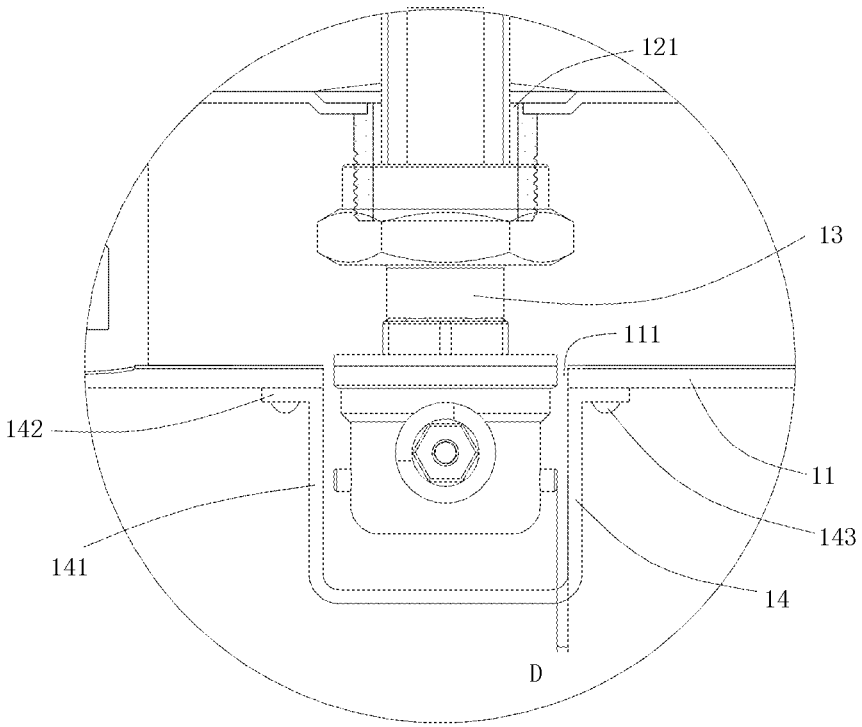
FIG. 2 is an enlarged view of part II of the electric water heater of FIG. 1.

With reference to FIG. 1 and FIG. 2, the electric water heater 10 according to embodiments of the present disclosure includes a casing 11, an inner tank 12, a drain valve 13 and a protection cover 14. The casing 11 is formed with an opening 111. The inner tank 12 is disposed in the casing 11 and formed with a drain outlet 121. The drain valve 13 is mounted at the drain outlet 121 and exposed from the opening 111. The protection cover 14 is detachably fixed on the casing 11 or the drain valve 13 and covering the drain valve 13.

The protection cover 14 of the electric water heater 10 according to embodiments of the present disclosure may be detached from the casing 11 during the sewage discharge, and fixed on the casing 11 again after the sewage discharge. Because of the protection of the protection cover 14, the drain valve 13 is no more exposed so as to avoid the potential safety risk. In addition, the protection cover 14 may further improve the integrity and the aesthetics of the appearance of the casing 11.

In some embodiments, the protection cover 14 may be made of insulating materials such as PP, ABS or PVC.

In some embodiments, a distance between the protection cover 14 and the drain valve 13 is greater than 2 mm, which may prevent the protection cover 14 from being electro-polarized and thus electrified.

In this embodiment, the protection cover 14 includes a tubular body 141 and a first flange 142 extended outwardly from an upper edge of the body 141, the first flange 142 is formed with a through hole (not shown) at an edge thereof, the casing 11 is formed with a screw hole (not shown) at an edge of the opening 111, the protection cover 14 is detachably fixed on the casing 11 by a screw 143 passing through the through hole and screwed into the threaded hole.

Certainly, the fixing way of the protection cover 14 is not limited to that in this embodiment.

Figure 3:
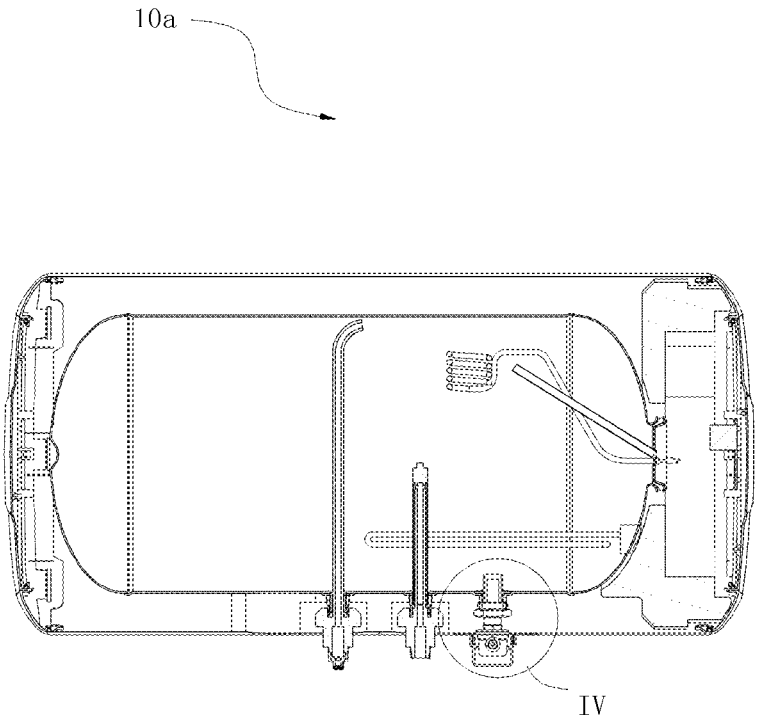
FIG. 3 is a schematic sectional view of an electric water heater according to a second embodiment of the present disclosure.
Figure 4:
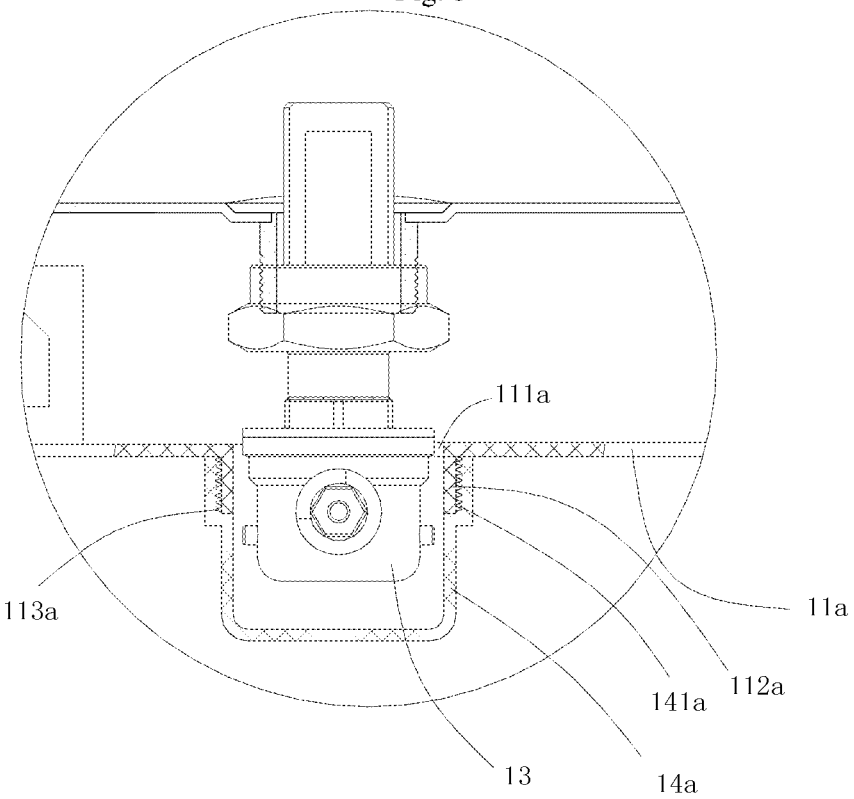
FIG. 4 is an enlarged view of part IV of the electric water heater of FIG. 3.

With reference to FIG. 3 and FIG. 4, an electric water heater 10*a* according to the second embodiment of the present disclosure is substantially the same as the electric water heater 10. However, in this embodiment, the protection cover 14*a* is cup-shaped, a first thread 141*a* is formed at an inner side wall of the protection cover 14*a*, the casing 11*a* includes a flange 112*a* extended outwardly from the edge of the opening 111*a*, and the flange 112*a* surrounds the drain valve 13. A second thread 113*a* is formed at an outer side wall of the flange 112*a*, the protection cover 14*a* is detachably fixed on the casing 11*a* by the first thread 141*a* and the second thread 113*a* engaged with each other. The flange 112*a* may also be positioned within the casing 11 and surrounded by the opening 111*a*, for example, the casing 11 is depressed inwardly from the opening 111*a* to form a depression, and the flange 112*a* is located in the depression and extended outwardly.

In this embodiment, a rough structure (not shown) may be formed at an outer surface of the protection cover 14, e.g., a corrugated structure, a rough surface, a plurality of protrusions or a plurality of depressions, so as to facilitate the operation.

Figure 5:
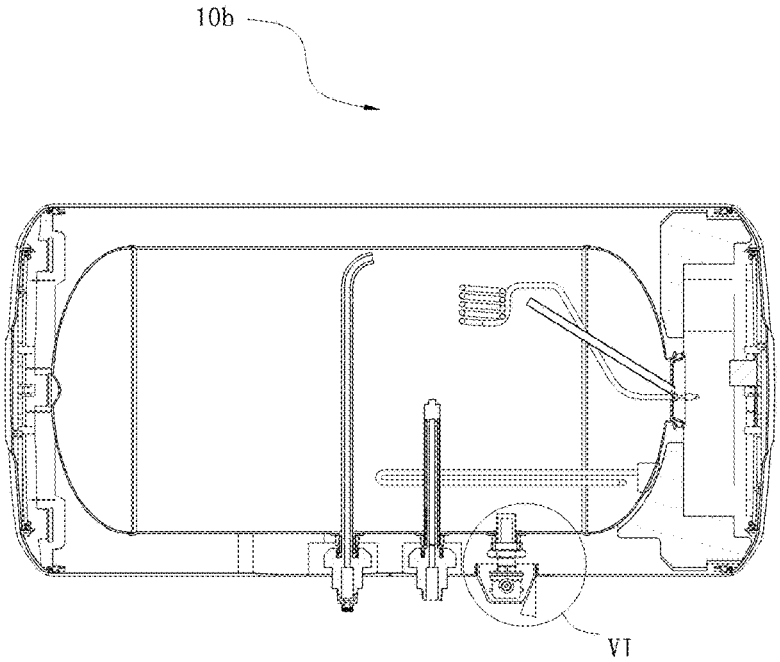
FIG. 5 is a schematic sectional view of an electric water heater according to a third embodiment of the present disclosure.
Figure 6:
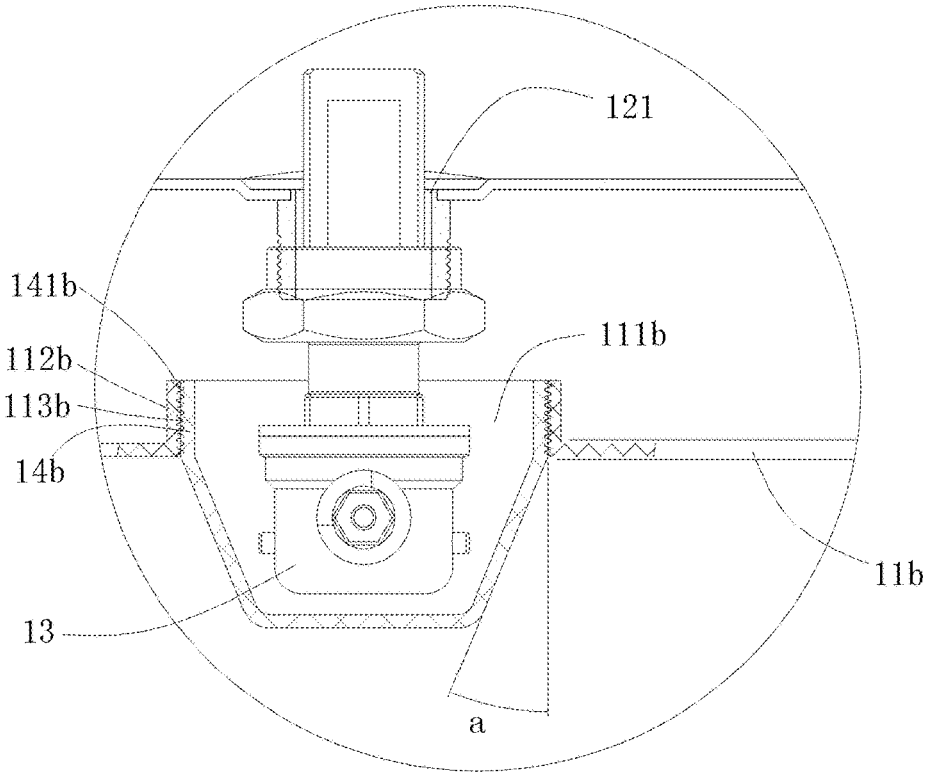
FIG. 6 is an enlarged view of part VI of the electric water heater of FIG. 5.

With reference to FIG. 5 and FIG. 6, an electric water heater 10*b* according to the third embodiment of the present disclosure is substantially the same as the electric water heater 10. However, in this embodiment, the protection cover 14*b* is cup-shaped, a third thread 141*b* is formed at an outer side wall of the protection cover 14*b*, the casing 11*b* includes a concave portion 112*b* extended inwardly from the edge of the opening 111*b*. A fourth thread 113*b* is formed at an inner side wall of the concave portion 112*b*, and the protection cover 14*b* is detachably fixed on the casing 11*b* by the third thread 141*b* and the fourth thread 113*b* engaged with each other.

Because a part of the protection cover 14*b* is disposed in the casing 11*b* so as to reduce the height of another part of the protection cover 14*b* exposed outside of the casing 11*b*, and the protection cover 14*b* is extended from the casing 11*b* with no seam in appearance, which may improve the integrity of the appearance.

In the third embodiment of the present disclosure, the protection cover is detachably connected to a valve body of the drain valve via a screw or a snapping tongue. Specifically, the valve body of the drain valve may be formed with a threaded hole and the protection cover is connected to the valve body of the drain valve via a screw. Alternatively, the protection cover may be provided with a snapping tongue and the snapping tongue is detachably engaged with the valve body of the drain valve.

In some embodiments, a part of the protection cover 14*b* exposed outside of the casing 11*b* has a truncated cone-shaped structure, and a diameter of the protection cover 14*b* becomes smaller as a distance from the protection cover 14*b* to the casing 11*b* increases. In this way, in the case of too large size of the drain outlet 121, it is possible to reduce the size of the end of the protection cover 14*b* so as to facilitate the operation. Furthermore, the truncated cone-shaped structure may also improve the aesthetics of the appearance.

A slant angle of the truncated cone-shaped structure of the protection cover 14*b* ranges from 5° to 25°.

Figure 7:
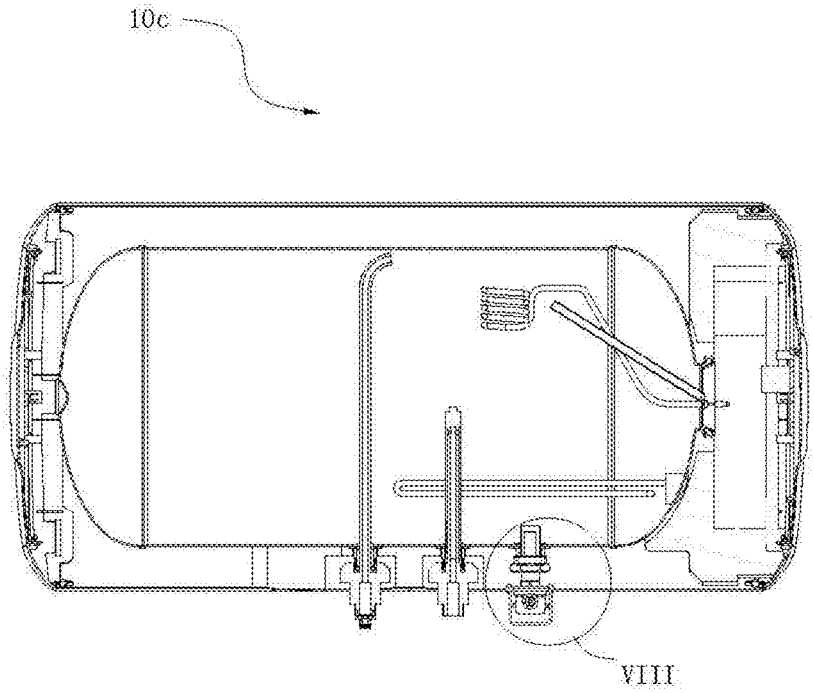
FIG. 7 is a schematic sectional view of an electric water heater according to a fourth embodiment of the present disclosure.
Figure 8:
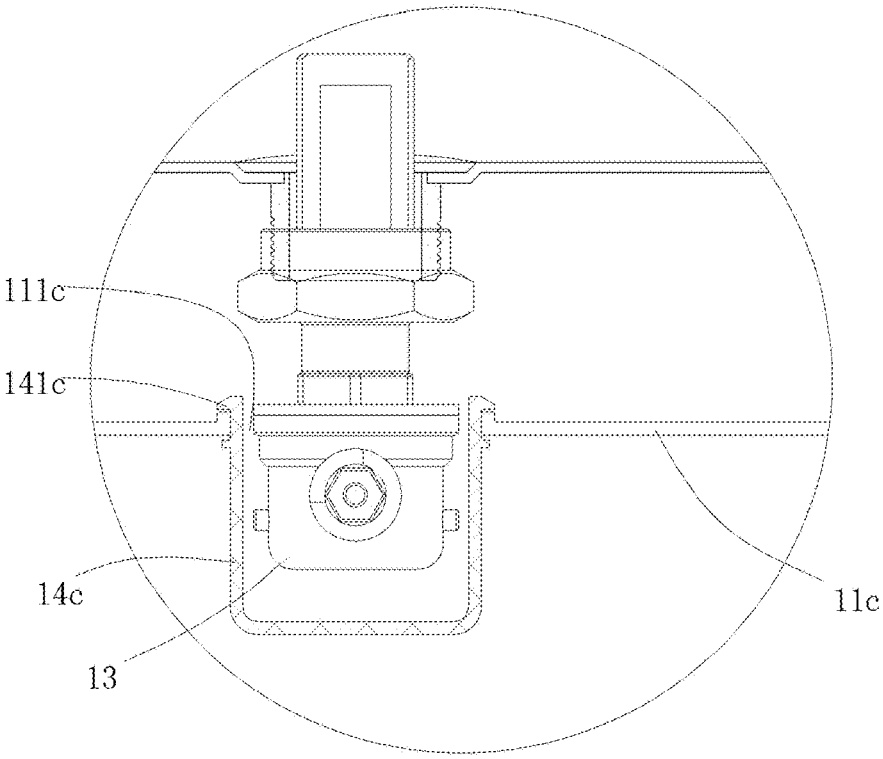
FIG. 8 is an enlarged view of part VIII of the electric water heater of FIG. 7.

With reference to FIG. 7 and FIG. 8, an electric water heater 10*c* according to the fourth embodiment of the present disclosure is substantially the same as the electric water heater 10. However, in this embodiment, the protection cover 14*c* is cup-shaped, at least two snapping tongues 141*c* are formed at an outer side wall of the protection cover 14*c* and distributed in a circumferential direction of the protection cover 14*c*, and the protection cover 14*c* is detachably fixed on the casing 11*c* by engaging the snapping tongues 141*c* with the edge of the opening 111*c*.

Bumps (not shown) are formed at the edge of the opening 111*c*, the snapping tongues 141*c* engage with the bumps respectively. For example, the snapping tongue 141*c* includes two flanges (not shown) extended from the outer side wall of the protection cover 14*c*, and the bump is snap-fitted between the two flanges.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples. In addition, those skilled in the art may combine and composite different embodiments or examples and features of various embodiments or examples embodiment described in the description with no conflicting situation.

Although explanatory embodiments have been shown and described, it would be appreciated by those skilled in the art that the above embodiments are exemplary and may not be construed to limit the present disclosure, and changes, alternatives, and modifications may be made in the embodiments within the scope of the present disclosure.

What is claimed is:

1. An electric water heater, comprising:

a casing defining an opening, an inner tank disposed in the casing and defining a drain outlet, a drain valve mounted at the drain outlet and exposed from the opening, and a protection cover detachably fixed on the casing or the drain valve and covering the drain valve, and wherein the protection cover has a cup-shape, a first thread is formed at an outer side wall of the protection cover, the casing comprises a cup-shaped concave portion extended inwardly from an outer surface of the casing and surrounding the drain valve, a second thread is formed at an inner side wall of the concave portion, the protection cover is detachably fixed on the casing only by the first and second threads engaged with each other, and a lower part of the protection cover is disposed in the casing such that an outer edge of an upper part of the protection cover extends from an adjacent outer surface of the casing, the outer edge of the protection cover and the outer surface of the casing meeting in an aesthetically seamless manner to thereby provide structural and insulative protection of the protection cover relative the drain valve, and wherein the cup-shaped concave portion is configured to prevent an inner surface of the casing from splashing liquid expelled from the drain valve.

2. The electric water heater according to claim 1, wherein the protection cover is detachably connected to a valve body of the drain valve via a screw or a snapping tongue.

3. The electric water heater according to claim 1, wherein a distance between the protection cover and the drain valve is greater than 2 mm.

4. The electric water heater according to claim 1, wherein a part of the protection cover exposed outside of the casing has a truncated cone-shaped structure, and a diameter of the protection cover becomes smaller as a distance from the protection cover to the casing increases.

5. The electric water heater according to claim 4, wherein a slant angle of the truncated cone-shaped structure of the protection cover ranges from 5° to 25°.

6. The electric water heater according to claim 1, wherein the protection cover is made of PP, ABS or PVC.

7. The electric water heater according to claim 1, wherein a rough structure is formed at an outer surface of the protection cover.

* * * * *